US011957168B2

(12) United States Patent
Liu

(10) Patent No.: US 11,957,168 B2
(45) Date of Patent: Apr. 16, 2024

(54) ATOMIZER AND ELECTRONIC CIGARETTE COMPRISING THE SAME

(71) Applicant: Shenzhen Eigate Technology Co., Ltd., Shenzhen (CN)

(72) Inventor: Tuanfang Liu, Shenzhen (CN)

(73) Assignee: SHENZHEN EIGATE TECHNOLOGY CO., LTD., Shenzhen (CN)

( * ) Notice: Subject to any disclaimer, the term of this patent is extended or adjusted under 35 U.S.C. 154(b) by 138 days.

(21) Appl. No.: 17/519,506

(22) Filed: Nov. 4, 2021

(65) Prior Publication Data

US 2022/0369708 A1 Nov. 24, 2022

(30) Foreign Application Priority Data

May 22, 2021 (CN) ..... 202110561318.7
May 22, 2021 (CN) ..... 202121109831.4

(51) Int. Cl.
*A24F 40/10* (2020.01)
*A24F 40/42* (2020.01)
*A24F 40/46* (2020.01)

(52) U.S. Cl.
CPC ..... *A24F 40/42* (2020.01); *A24F 40/10* (2020.01); *A24F 40/46* (2020.01)

(58) Field of Classification Search
CPC ..... A24F 40/42; A24F 40/10; A24F 40/46
See application file for complete search history.

(56) References Cited

U.S. PATENT DOCUMENTS

2022/0312838 A1* 10/2022 Potter ..... A24F 40/42

OTHER PUBLICATIONS

English machine translation of Specification of Dong CN 1116164414 (Year: 2020).*

* cited by examiner

*Primary Examiner* — Michael J Felton
*Assistant Examiner* — Daniel Edward Vakili
(74) *Attorney, Agent, or Firm* — MATTHIAS SCHOLL P.C.; Matthias Scholl

(57) ABSTRACT

An atomizer includes a heating assembly, a first e-liquid collector, and a second e-liquid collector. The first e-liquid collector and the second e-liquid collector are disposed under the heating assembly. The first e-liquid collector is configured to store condensed e-liquid; and the second e-liquid collector is configured to store the condensed e-liquid overflowing out of the first e-liquid collector. The first e-liquid collector is disposed near the heating assembly.

4 Claims, 4 Drawing Sheets

ATOMIZER AND ELECTRONIC CIGARETTE COMPRISING THE SAME

CROSS-REFERENCE TO RELATED APPLICATIONS

Pursuant to 35 U.S.C. § 119 and the Paris Convention Treaty, this application claims foreign priority to Chinese Patent Application No. 202110561318.7 filed May 22, 2021, and to Chinese Patent Application No. 202121109831.4 filed May 22, 2021. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND

The disclosure relates to an atomizer and an electronic cigarette comprising the same.

In conventional atomizers, when the atomized e-liquid cools down, it condenses into e-liquid and accumulates in the air channel. The condensed e-liquid easily flows through the air inlet or the air channel, and leaks outside the atomizer, thus bringing bad user experience and shortening the service life of the atomizer.

SUMMARY

The first objective of the disclosure is to provide an atomizer; the atomizer comprises a heating assembly, a first e-liquid collector, and a second e-liquid collector. The first e-liquid collector and the second e-liquid collector are disposed under the heating assembly. The first e-liquid collector is configured to store condensed e-liquid; and the second e-liquid collector is configured to store the condensed e-liquid overflowing out of the first e-liquid collector. The first e-liquid collector is disposed near the heating assembly.

In a class of this embodiment, both the first e-liquid collector and the second e-liquid collector are in the form of a concave portion or a recess portion; and/or the second e-liquid collector is disposed under the first e-liquid collector.

In a class of this embodiment, the atomizer further comprises an atomizing channel and the heating assembly is disposed in the atomizing channel; the atomizing channel comprises an inner wall and two protrusions extending from the inner wall; the two protrusions are separately in the shape of a hook; the at least two concave portions are formed by the at least two corresponding protrusions and the inner wall of the atomizing channel to function as the first e-liquid collector; each of the at least two concave portion is disposed under the heating assembly and comprises an open top facing the heating assembly.

In a class of this embodiment, the atomizer further comprises an e-liquid seal member and a housing, and the housing comprises an e-liquid chamber; the e-liquid seal member is disposed in the housing to seal the e-liquid chamber; the atomizing channel is formed in the e-liquid seal member and the heating assembly is disposed in the e-liquid seal member.

In a class of this embodiment, the housing comprises an open end away from the e-liquid seal member and functioning as a mouthpiece; the housing further comprises an air conduction tube communicating with the open end and the atomizing channel; the e-liquid chamber is defined by the e-liquid seal member, the air conduction tube, and the housing.

In a class of this embodiment, the heating assembly comprises an e-liquid absorption member and a heating element disposed on the e-liquid absorption member; and the air conduction tube abuts against the e-liquid absorption member.

In a class of this embodiment, the heating assembly further comprises two grooves disposed oppositely to each other on the inner wall of the atomizing channel; both ends of the e-liquid absorption member are disposed on the two grooves, respectively; the two protrusions are disposed oppositely to each other and extend from the inner wall of the atomizing channel to form the at least two concave portions each with the open top facing the heating assembly; and the two grooves are separately in the shape of "U"; the heating assembly is horizontally disposed on the two grooves; the at least two concave portions are disposed on both sides of the two grooves rather than under the two grooves, so that the condensed-liquid can flow into the at least two concave portions.

In a class of this embodiment, the atomizer further comprises a fixing member and the housing further comprises a distal end portion away from the mouthpiece; the fixing member is disposed in the distal end portion under the e-liquid seal member; the recess portion is disposed in the fixing member to function as the second e-liquid collector; the recess portion comprises a top opening facing toward the two protrusions; an outer wall of each of the two protrusion is projected vertically on an inner wall of the recess portion to ensure that the condensed e-liquid flows down the two protrusions into the recess portion.

In a class of this embodiment, the top opening of the recess portion is defined by a top edge and the top edge abuts against both ends of the e-liquid seal member; a gap is formed between the two protrusions and communicates with the top opening of the recess portion, thus concentrating the flow of the condensed e-liquid into the recess portion In a class of this embodiment, the e-liquid seal member comprises an e-liquid guide part disposed on a side or bottom portion of an outside wall of each of the concave portion and extending into the recess portion; the fixing member comprises an air inlet covered by the e-liquid guide part; the e-liquid guide part is configured to conduct the e-liquid into the recess portion and prevent the e-liquid from flowing through the air inlet out of the atomizer.

The second objective of the disclosure is to provide an electronic cigarette; the electronic cigarette comprises the atomizer and a battery assembly.

The following advantages of the disclosure are associated with the atomizer and the electronic cigarette of the disclosure: the atomizer comprises the first e-liquid collector and the second e-liquid collector, both of which are configured to prevent leakage of the e-liquid; the heating assembly is disposed near the first e-liquid collector so as to atomize the e-liquid in the first e-liquid collector, thereby improving utilization of the e-liquid and prolonging atomizer life.

Figure 1:
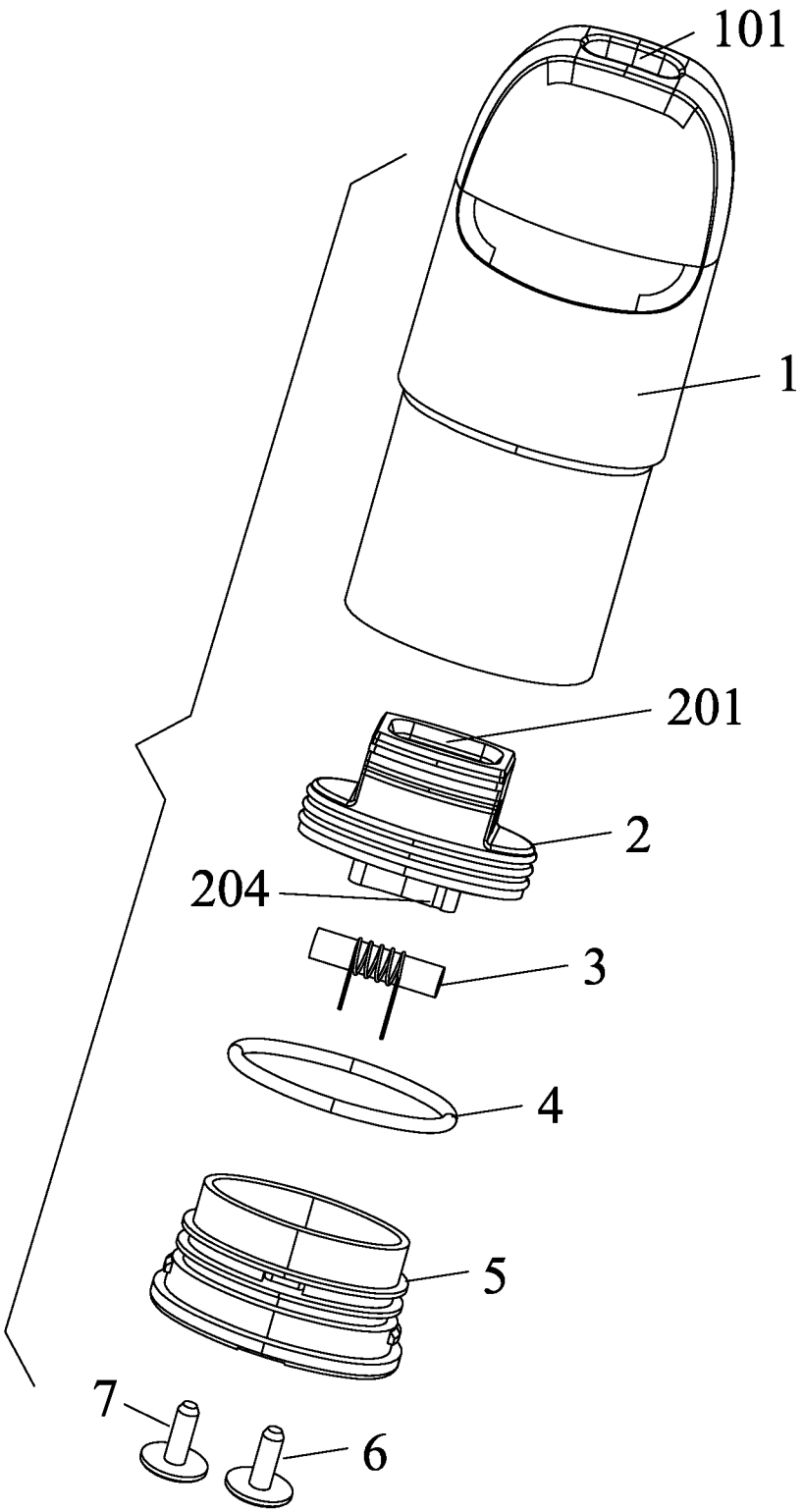
FIG. 1 is an exploded view of an atomizer according to one embodiment of the disclosure.

In the drawings, the following reference numbers are used: 1. Housing; 2. E-liquid seal member; 3. Heating assembly; 4. Seal ring; 5. Fixing member; 6. First electrode; 7. Second electrode; 101. Mouthpiece; 102. Air conduction channel; 103. Air conduction tube; 104. E-liquid chamber; 201. Atomizing channel; 202. Concave portion; 203. Protrusion; 204. E-liquid guide part; 501. Recess portion; and 502. Air inlet.

DETAILED DESCRIPTION

An electronic cigarette comprises an atomizer and a battery assembly; the atomizer is formed integrally with, fixedly connected to, or detachably connected to the battery assembly.

The atomizer comprises a housing 1, a first e-liquid collector, and a second e-liquid collector. An e-liquid chamber 104 is formed in the housing 1 and the housing 1 comprises an air conduction channel 102 disposed in the e-liquid chamber 104. The first e-liquid collector and the second e-liquid collector are disposed under the air conduction channel 102 to collect the condensed e-liquid. The condensed e-liquid first fills up the first e-liquid collector and then flows into the second e-liquid collector, which prevent leakage of the e-liquid, thereby improving utilization of the e-liquid.

Both the first e-liquid collector and the second e-liquid collector are in the form of a concave portion 202 or a recess portion 501, so that the condensed e-liquid can easily flow into the first and second e-liquid collectors.

The housing 1 further comprises an air conduction tube 103 that allows vapor or smoke to flow through. The air conduction tube 103 is disposed in the housing 1 and comprises a hollow column functioning as the air conduction channel 102.

The housing 1 comprises an open end functioning as a mouthpiece 101. The mouthpiece 101 communicates with the air conduction channel 102.

The atomizer further comprises a heating assembly 3 and an e-liquid seal member 2. The e-liquid seal member 2 is disposed in the housing 1 to seal the e-liquid chamber 104. The e-liquid member 2 comprises an atomizing channel 201 and the heating assembly 3 is disposed in the atomizing channel 201 to absorb and atomize the e-liquid. The heating assembly 3 comprises an e-liquid absorption member and a heating element. The e-liquid-absorbing member comprises an e-liquid-absorbing cotton, or an e-liquid-absorbing cloth. The heating element comprises a metal body member, or a ceramic body member provided with a metal conductive wire. The heating assembly 3 can refer to the e-liquid-absorbing cotton wound with the metal conductive wire, the e-liquid-absorbing cotton wrapped in the metal or ceramic body member, and the metal or ceramic body member wound with an e-liquid cord. The heating assembly 3 is configured to atomize the e-liquid and vegetable oil in the e-liquid chamber 104.

The air conduction tube 103 comprises a distal end away from the mouthpiece 101 and the distal end is disposed in the atomizing channel 201 to prevent leakage of e-liquid vapor or smoke. The e-liquid seal member 2 comprises silica gel, latex, rubber, etc., which are soft, has a large deformation coefficient, and achieves a good sealing effect.

The e-liquid seal member 2 comprises a first end comprising at least two protrusions 203. The at least two protrusions 203 extend into the atomizing channel 201 and the at least two concave portions 202 are defined by outer walls of the at least two corresponding protrusions 203 and an inner wall of the atomizing channel 201.

The first end of the e-liquid seal member 2 further comprises at least one e-liquid guide part 204 extending downward into the second e-liquid collector. Excess e-liquid overflows out of the first e-liquid collector down the at least one e-liquid guide part 204 into the second e-liquid collector, which prevents the condensed e-liquid from flowing into an airflow channel.

The atomizer further comprises a fixing member 5, a first electrode 6, and a second electrode 7. The housing 1 further comprises a distal end portion away from the mouthpiece 101 and the fixing member 5 is disposed in the distal end portion. The air inlet 502, the first electrode 6, and the second electrode 7 are disposed on one end of the fixing member 5. Both the first electrode 6 and the second electrode 7 separately comprise a conductive material for making electrical connection to positive and negative pins of the heating element, thereby allowing the heating element to produce heat for atomization. The e-liquid guide part 204 can prevent the condensed e-liquid from flowing into the air inlet 502

Another end of the fixing member 5 is connected to the first end of the e-liquid seal member 2. The recess portion 501 is disposed in the fixing member 5 and configured to function as the second e-liquid collector. The at least two protrusions 203 are disposed on the recess portion 501 and a gap is formed between the at least two protrusions, so that the atomizing channel 201 communicates with the recess portion 501. The at least one e-liquid guide part 204 is disposed in the recess portion 501. Excess e-liquid overflows out of the first e-liquid collector, through the gap, down the at least one e-liquid guide part 204, and into the second e-liquid collector.

The atomizer further comprises a seal ring 4 disposed between the fixing member 5 and the housing 1.

Figure 2:
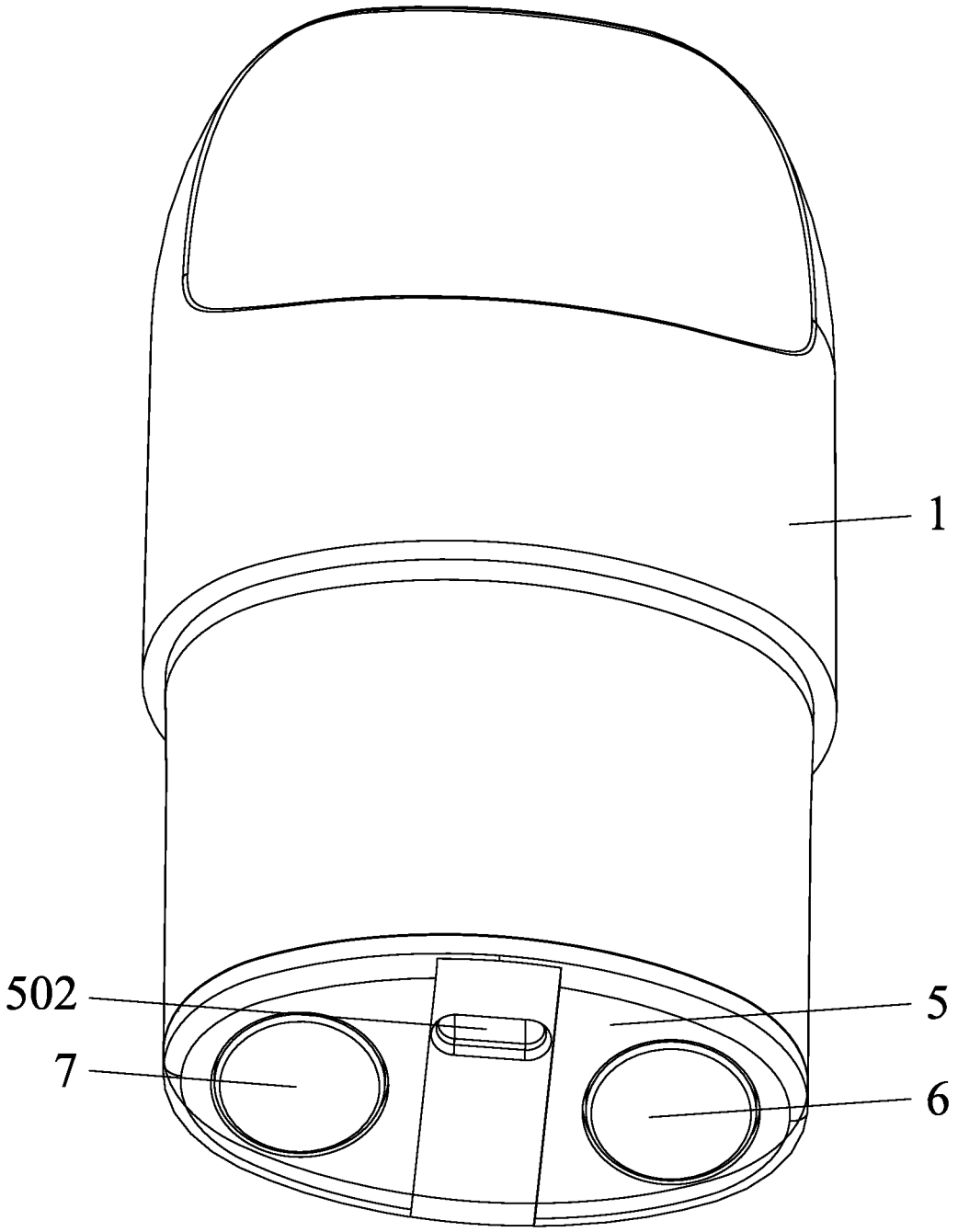
FIG. 2 is a perspective view of an atomizer according to one embodiment of the disclosure.
Figure 3:
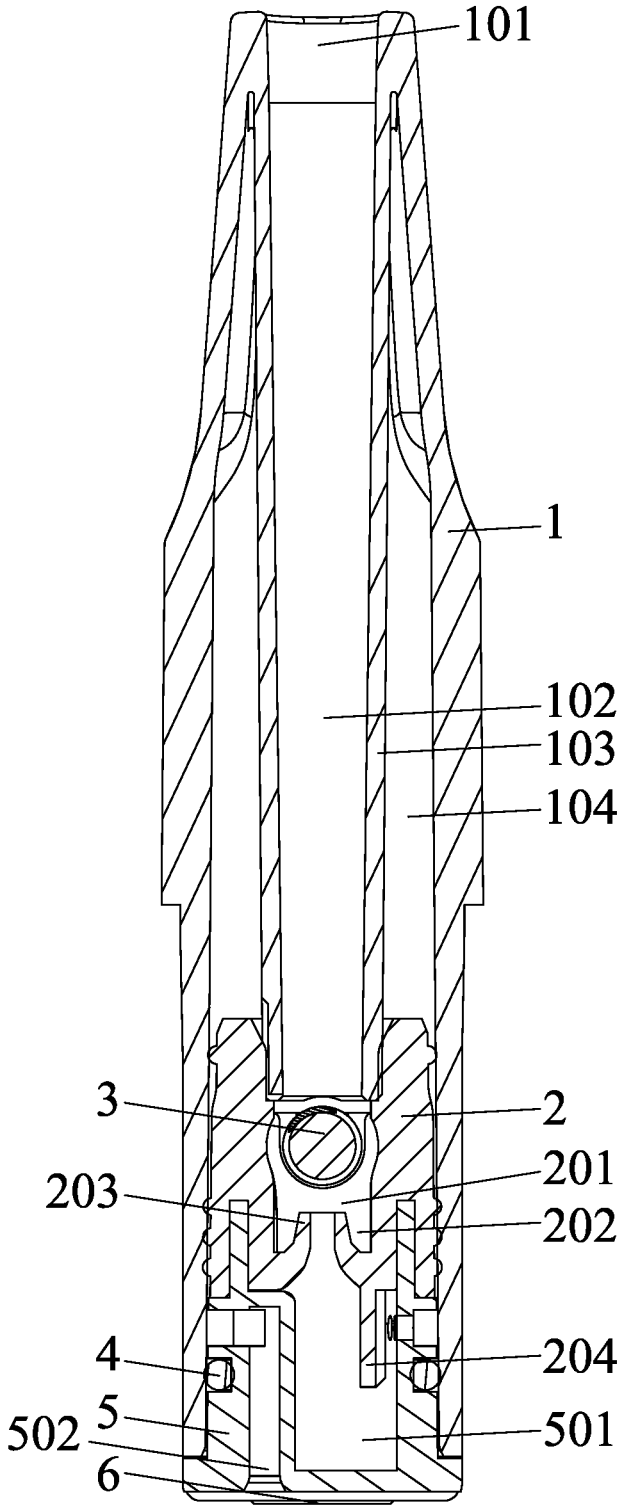
FIG. 3 is a cross-sectional view of an atomizer according to one embodiment of the disclosure.

Referring to FIGS. 1-3, in certain embodiments, an atomizer comprises the housing 1, the e-liquid seal member 2, the heating assembly 3, the seal ring 4, the fixing member 5, the first electrode 6, and the second electrode 7. The e-liquid chamber 104 is formed in the housing 1. The e-liquid seal member 2 is disposed in the housing 1 to prevent the e-liquid from leaking out of the e-liquid chamber 104. The housing 1 comprises the air conduction tube 103 for air conduction and emission. The housing 1 further comprises the open end functioning as the mouthpiece 101. The air conduction tube 103 is disposed in the housing 1 and comprises a hollow column as the air conduction channel 102. The mouthpiece 101 communicates with the air conduction channel 102. The air conduction tube 103 comprises the distal end away from the mouthpiece 101 and the distal end is disposed in the atomizing channel 201 to prevent leakage of e-cigarette vapor or smoke. The heating assembly 3 is disposed in the atomizing channel 201 to atomize the e-liquid. The e-liquid seal member 2 comprises a first end comprising the at least two protrusions 203. The at least two protrusions 203 extend into the atomizing channel 201 and the concave portion 202 are defined by the outer walls of the at least two corresponding protrusions 203 and the inner wall of the atomizing channel 201. The first end of the e-liquid seal member 2 further comprises the at least one e-liquid guide part 204 extending downward into the second e-liquid collector. Excess e-liquid overflows out of the at least two concave portions 202 and enters the recess portion 501 via the at least one e-liquid guide part 204, which prevents the condensed e-liquid from flowing into the airflow channel and the air inlet 502. The fixing member 5 is disposed in the bottom of the housing 1 to support the e-liquid seal member 2 and limit change in position of the e-liquid seal member 2. The air inlet 502, the first electrode 6, and the second electrode 7 are disposed on one end of the fixing member 5. Both the first electrode 6 and the second electrode 7 separately comprise a conductive material for making electrical connection to positive and negative pins of the heating element, thereby allowing the heating element to produce heat. Another end of the fixing member 5 is connected to the first end of the e-liquid seal member 2. The at least two protrusions 203 are disposed on the recess portion 501 and the gap is formed between the at least two protrusions, so that the atomizing channel 201 communicates with the recess portion 501. The at least one e-liquid guide part 204 is disposed in the recess portion 501. Excess e-liquid overflows out of the at least two concave portions 202, through the gap, down the at least one e-liquid guide part 204, and into the recess portion 501, thereby prevent leakage of the e-liquid. The seal ring 4 is disposed between the fixing member 5 and the housing 1 to enhance the leak resistance of the atomizer.

Figure 4:
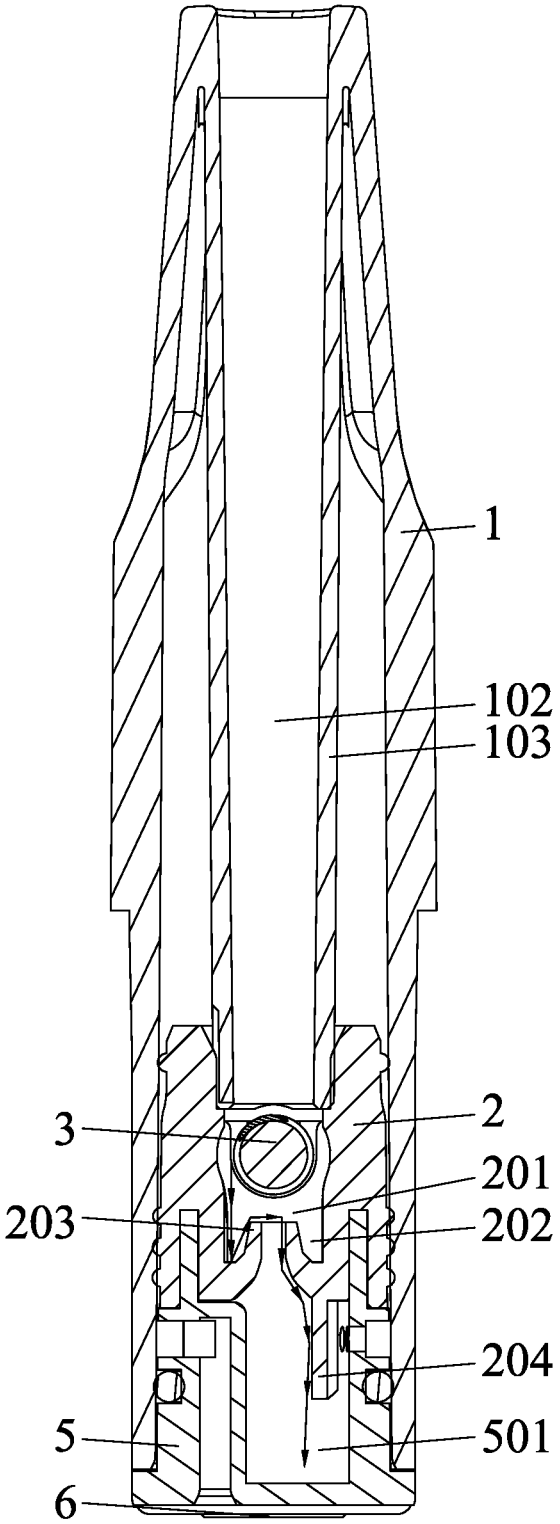
FIG. 4 is a cross-sectional view including arrows showing the flow direction of condensed e-liquid in an atomizer according to one embodiment of the disclosure.

FIG. 4 is a cross-sectional view including arrows showing the flow direction of the condensed e-liquid in the atomizer. When the e-cigarette vapor cools down, it condenses into the e-liquid and flows along the inner wall of the atomizing channel 201 into the at least two concave portions 202. Excess e-liquid overflows out of the at least two concave portions 202 down the e-liquid guide part 204 into the recess portion 501, thereby prevent leakage of the condensed-e-liquid.

It will be obvious to those skilled in the art that changes and modifications may be made, and therefore, the aim in the appended claims is to cover all such changes and modifications.

What is claimed is:

1. An atomizer, comprising:

a housing;

a heating assembly;

an air conduction tube;

an e-liquid seal member; and a fixing member;

wherein;

the air conduction tube is disposed inside the housing;

a first end of the air conduction tube is connected to a first longitudinal end of the housing;

an opening is disposed on the first longitudinal end of the housing and communicates with a space inside the air conduction tube, and the first longitudinal end of the housing functions as a mouthpiece;

the e-liquid seal member is disposed inside the housing and seals a ring -shaped aperture formed between the housing and a second end of the air conduction tube, and an e-liquid chamber is enclosed by the housing, the air conduction tube, and the e-liquid seal member;

an atomizing channel is disposed inside the e-liquid seal member, and a second end of the air conduction tube is disposed in the atomizing channel;

the heating assembly is disposed in the atomizing channel; the atomizing channel comprises an inner wall and two protrusions extending from the inner wall; a base of each of the two protrusions is connected to the inner wall, a body of each of the two protrusions is sloped toward the second end of the air conduction tube, and a cross-section of each of the two protrusions is in a hook shape; a concave portion is formed between each of the two protrusions and the inner wall of the atomizing channel; an opening of the concave portion faces toward the second end of the air conduction tube, and the concave portion functions as a first e-liquid collector; and the heating assembly is disposed between the two protrusions and the second end of the air conduction tube;

the fixing member is disposed on a second longitudinal end of the housing and comprises a recess portion; and the recess portion comprises a top opening facing toward the two protrusions and functions as a second e-liquid collector.

2. The atomizer of claim 1, wherein a gap is formed between the two protrusions and communicates with the top opening of the recess portion.

3. The atomizer of claim 1, wherein the e-liquid seal member comprises an e-liquid guide part disposed on a side or bottom portion of an outside wall of the concave portion and extending into the recess portion; the fixing member comprises an air inlet covered by the e-liquid guide part.

4. An electronic cigarette, comprising the atomizer of claim 1 and a battery assembly.

* * * * *